United States Patent [19]

Ellis

[11] 4,261,577

[45] Apr. 14, 1981

[54] WASHER PROJECTING GAME APPARATUS

[76] Inventor: Lonnie T. Ellis, 33-A Ellis La., Orange, Tex. 77630

[21] Appl. No.: 76,912

[22] Filed: Sep. 19, 1979

[51] Int. Cl.[3] ..... A63F 9/02

[52] U.S. Cl. ..... 273/355; 124/7; 273/357; 273/399

[58] Field of Search ..... 273/337, 355, 356, 357, 273/399, 126 R; 124/7

[56] References Cited

U.S. PATENT DOCUMENTS

| | | | |
|---|---|---|---|
| 226,615 | 4/1880 | Ingalls | 273/126 R |
| 1,257,174 | 2/1918 | Bailey | 273/126 R |
| 2,432,824 | 12/1947 | Shetler | 273/355 |
| 2,520,460 | 8/1950 | Ford | 273/355 |
| 4,111,179 | 9/1978 | Hashimoto | 124/7 |

FOREIGN PATENT DOCUMENTS

| | | | |
|---|---|---|---|
| 1493083 | 7/1967 | France | 273/355 |

*Primary Examiner*—Anton O. Oechsle

*Attorney, Agent, or Firm*—Jack W. Hayden

[57] ABSTRACT

A washer game includes a playing board of a generally rectangular configuration having side and end surfaces extending upwardly above the plane of the playing board surface. Pocket means adjacent, but spaced from each end of the game board playing surface is provided which pocket means include openings of a predetermined size and configuration adjacent but spaced from each end of the game board playing surface. Washer shooter means are provided for mounting adjacent each end of the game board surface with spring tensioned washer support means whereby a washer may be placed on the support means and the support means pulled against the spring and thereafter released so that the tension in the spring throws a washer on the surface of the game board surface in any of various predetermined angles in relation to the game board surface to try to place the washer in one of the pocket means on the game board surface.

8 Claims, 4 Drawing Figures

WASHER PROJECTING GAME APPARATUS

SUMMARY OF THE INVENTION

The present invention relates to a game board surface and more particularly to a game board surface having pocket means including openings arranged on the game board surface for receiving washers which are thrown onto the game board surface in an endeavor to place the washers in the pocket means. A shooter means is provided for removable positioning adjacent either or both ends of the game board surface so that a player may place a washer on a washer support means carried by the washer shooter means and the washer support means then activated in an endeavor to throw the washer at a selected angle or position in relation to the game board surface and into one of the pockets thereon.

Other objects and advantages of the present invention will become apparent from a consideration of the following description and drawings.

DESCRIPTION OF THE PREFERRED EMBODIMENT

Figure 1:
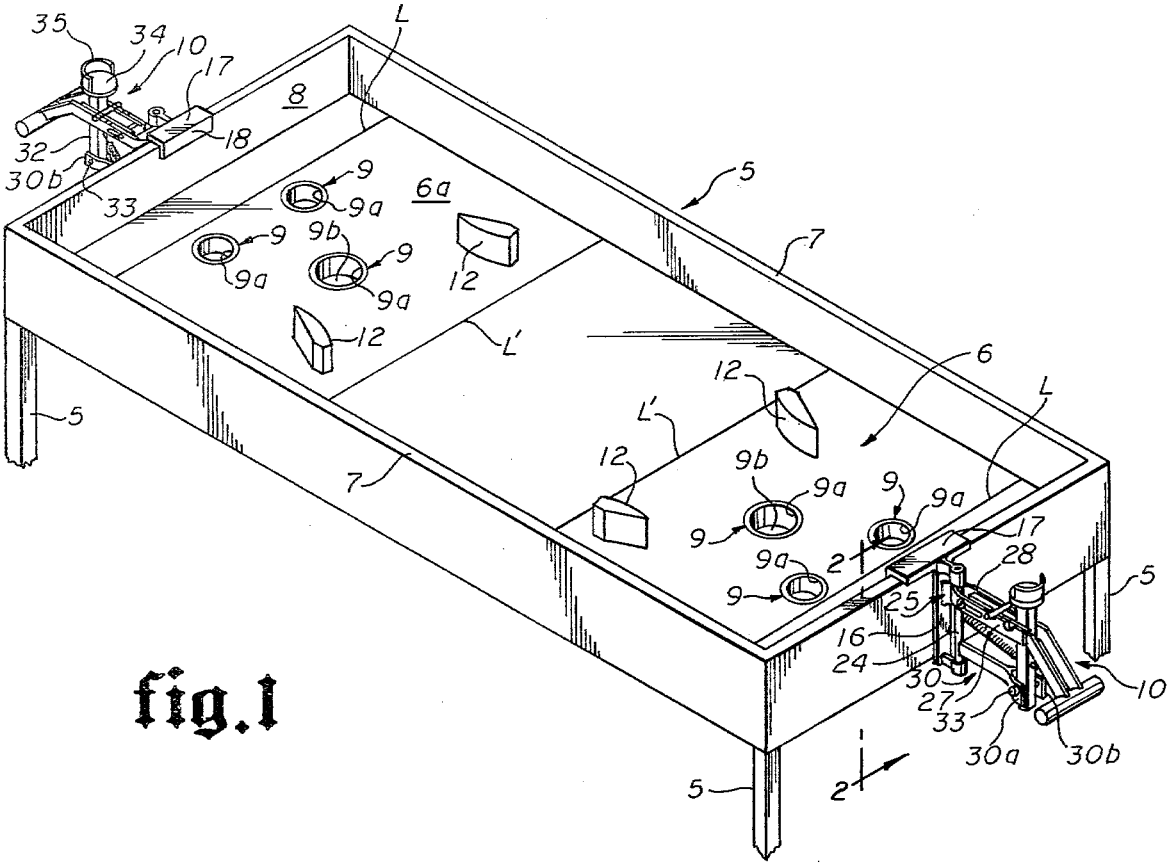
FIG. 1 is a perspective view illustrating a preferred arrangement of the game board surface means with the shooter means positioned adjacent each end thereof.

Attention is first directed to FIG. 1 of the drawings wherein the washer game of the present invention is referred to generally by the numeral 5. It is shown as including a playing board surface means referred to generally at 6 having sides 7 and ends 8 which project upwardly above the plane of the surface 6a of the playing board means 6 as shown in the drawings to assist in keeping the washers from going off of the board during play.

The playing board surface means 6 is preferably flat and rectangular shaped as illustrated in FIG. 1 of the drawings with pocket means 9 preferably arranged as shown in FIG. 1 of the drawings. The pocket means 9 include a plurality of openings 9*a* in the surface 6*a* of the playing board surface means 6. It will be noted that one of the openings 9*a* is more remote from each of the ends 8 than the other two openings 9*a*. Also, the openings 9*a*, as shown in the form of the invention illustrated, are arranged so that their relationship form generally an equilateral triangular on the surface 6*a* of the playing board means 6 with one of the openings 9*a* being at the apex of the triangle and the other two openings 9*a* being respectively at the base angles of the triangle.

Figure 4:
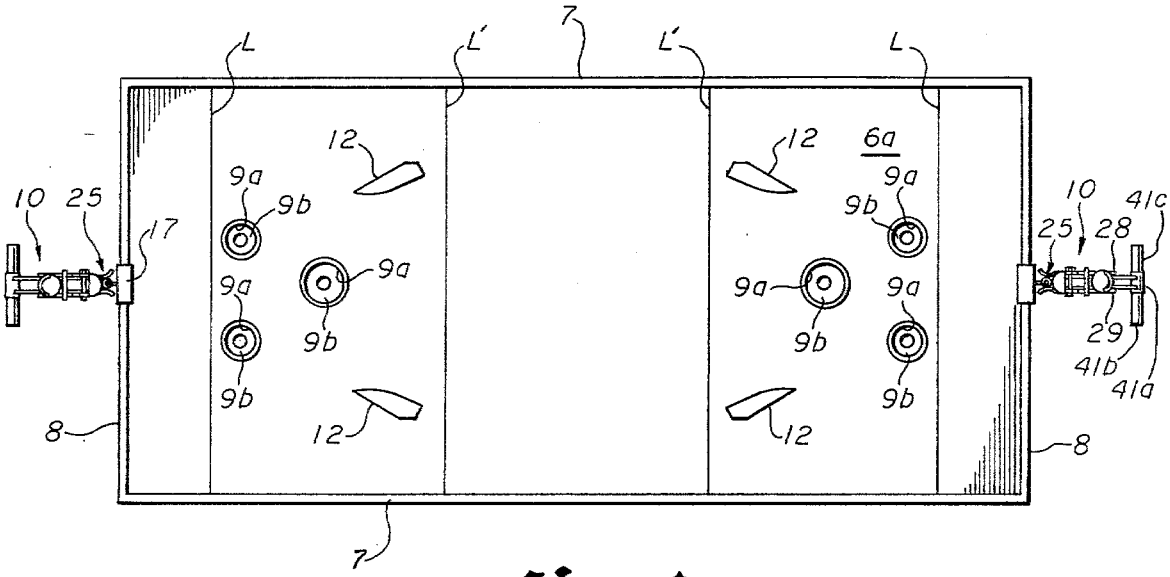
FIG. 4 is a plan view of the game board surface means.

Also, the opening 9*a* which is at the apex of the triangularly arranged openings is somewhat larger in diameter as illustrated more clearly in FIG. 4 for purposes that will be described.

Each of the openings 9*a* is provided with a receptacle 9*b* formed of any suitable material such as cloth, leather, metal or the like which extends below the nether side 6*b* of the playing surface and provides a means for receiving the washer W when it moves into the opening 9*a*, and also provides a means whereby the washer may be retrieved after each player has taken a turn at shooting the washer W onto the playing surface 6*a*.

Guide surface means referred to generally at 12 are provided on the playing surface 6*a* and extend upwardly therefrom. As shown, four of such guide surface means 12 are provided and are arranged at an angle relative to the opening 9*a* which forms the apex of the triangularly arranged openings so that a player during use of the game of the present invention may attempt, if desired, to throw a washer onto the playing board surface 6 and strike one of the guide surfaces 12 at the opposite end from the shooter means at which the player is positioned in a manner so as to guide or bank the washer into one of the openings 9*a*.

Washer shooter means referred to generally by the numeral 10 are provided for mounting adjacent each of the ends 8 for propelling or throwing a washer W onto the game board surface means 6 and into one of the pocket means referred to generally by the numeral 9.

Figure 2:
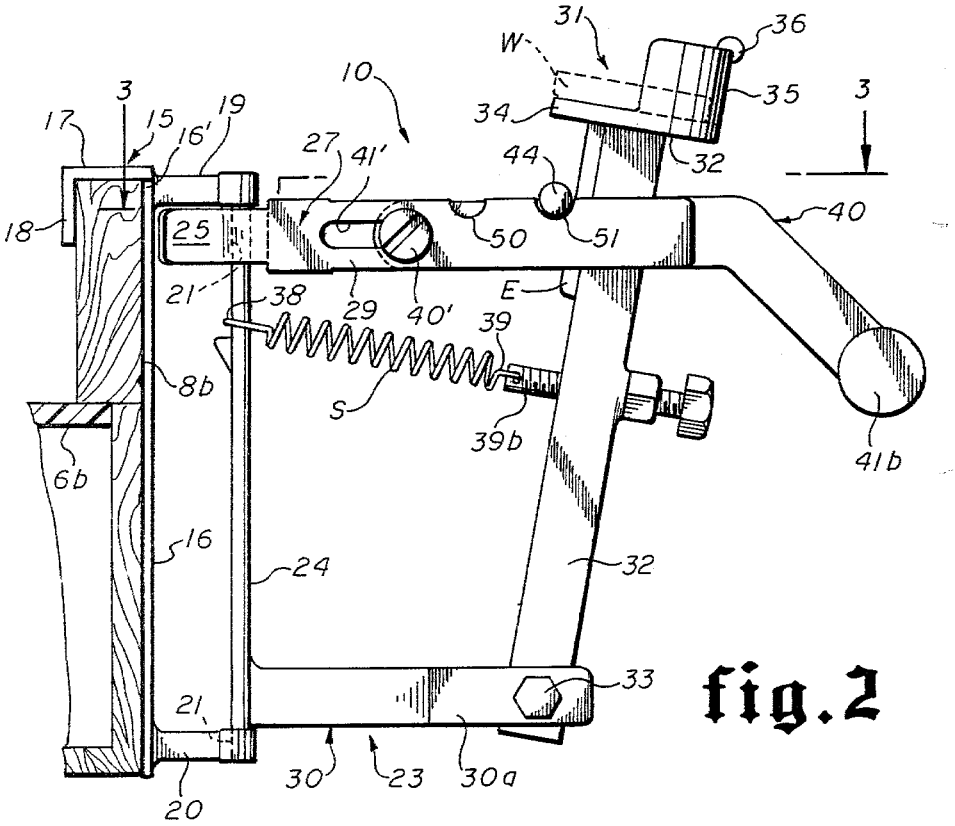
FIG. 2 is a sectional view on the line 2—2 of FIG. 1, partly in elevation illustrating in greater detail the washer shooter means.
Figure 3:
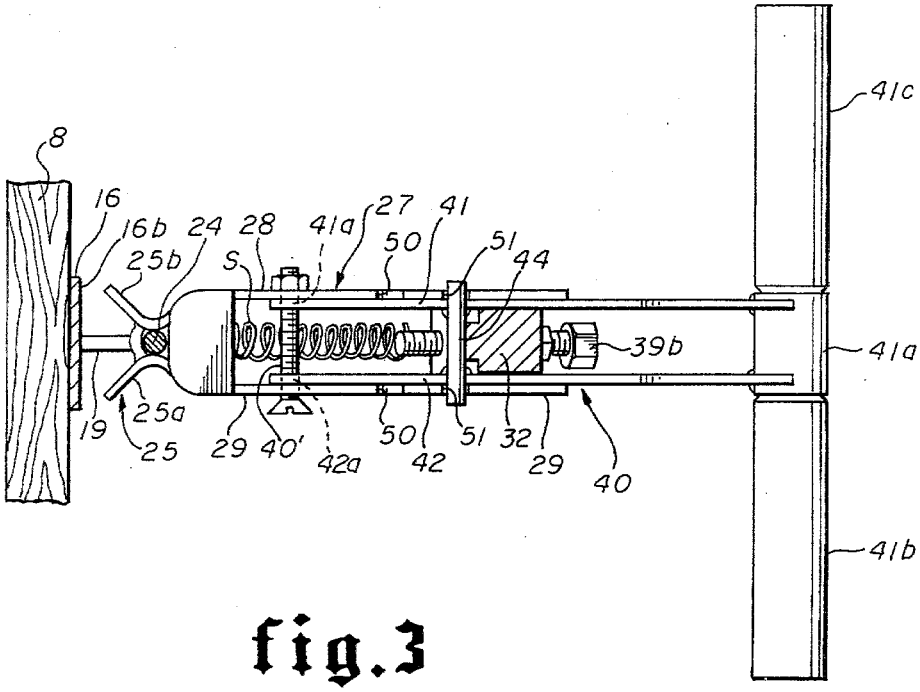
FIG. 3 is a view on the line 3—3 of FIG. 2 to illustrate further details of the washer shooter means.

The washer shooter means 10 shown in FIGS. 2 and 3 in greater detail includes support means referred to generally at 15 formed by a generally vertically extending plate member 16 for abutting the surface 8*b* of the end 8. A forwardly extending portion 17 at the upper end 16' of plate 16 has a downwardly extending portion 18 spaced from the plate member 16 to provide an arrangement so that the shooter means 10 may be hung in position on the end 8 of the playing surface means 6 as shown in the drawings and may be readily removed therefrom when the game is not in use.

Spaced upper and lower extensions 19 and 20 project rearwardly from the plate member 16 and each extension 19 and 20 is provided with a vertical opening 21 therein.

Bracket means referred to generally by the numeral 23 are pivotally supported by the extensions 19 and 20 of the support means 15. The bracket means 23 includes a generally vertically extending member 24 which extends between the projections 19 and 20 with each end of the member 24 fitting in the openings 21 for pivotally supporting the bracket means 23 so that the bracket means 23 may be moved in a plane laterally relative to the longitudinal axis of playing surface 6*a* for propelling or throwing a washer onto the playing surface at any of several desired angular relationships in relation to a plane through the longitudinal axis of the playing surface 6*a*.

The bracket means 23 also includes an upper channel shaped member generally referred to at 27 that is mounted adjacent the upper end of the vertical member 24 and extends rearwardly and laterally relative to the vertical member 24 as shown in the drawings. The upper channel shaped member 27 includes the sides 28 and 29 extending rearwardly relative to the vertical member 24 as shown in FIGS. 2 and 3 of the drawings.

The bracket means 23 further includes a lower member referred to generally at 30 which is secured adjacent the lower end of the vertical member 24 and extends rearwardly and laterally of the member 24 in generally the same vertical plane as the upper channel shaped member 27. The lower member 30 is provided with spaced members 30*a* and 30*b* at its rear end to form a yoke.

The bracket means 23 further includes a movable member 32 pivotally connected adjacent its lower end between the members 30*a*, 30*b* by suitable pin means as illustrated at 33 in FIG. 2. The movable member 32 extends upwardly from its pivotal connection with the member 30 in generally the same vertical plane as the rod 24. The member 24 projects or extends between the sides 28 and 29 of the upper channel shaped member 27 to terminate at a point above the upper channel or U-shaped member 27 as shown more clearly in FIG. 2.

Washer support means referred to generally at 31 is provided for enabling a washer W to be supported by the washer shooter means 10 and to be thrown or propelled onto the surface 6*a* of the game board 6.

The washer support means 31 includes a seat 34 mounted on the upper end 32*a* of the movable member 32. The seat 34 is preferably circular in plan view for receiving a washer W thereon as shown in dotted line in FIG. 2. An arcuate back support 35 is mounted on the rear portion of seat 34 and extends upwardly therefrom to aid in retaining a washer W in position on the seat 34 when it is thereon and as the member 32 is actuated to throw the washer W onto the surface 6*a*.

An enlargement 36 is provided adjacent the upper edge of the seat 35 to enable the washer support means 31 including the member 32 to be manually engaged and moved rearwardly against the tension of the spring S which is connected at one end 38 to the vertical member 24 and its other end 39 by any suitable means as represented at 39*b* to the upwardly extending and movable member 32 of the washer support means to enable the washer W to be thrown onto the surface 6*a* when it is pulled against the tension exerted by spring S thereafter released as will be described in greater detail.

Stop means referred to generally at 25 are provided to limit the pivotal movement of the shooter means 10 about to the vertical axis of the member 24. The stop means 25 is formed by the extensions 25*a*, 25*b* extending from upper channel member 27 and flaring outwardly away from each other as seen more clearly in FIG. 3. The flared members 25*a*, 25*b* extend forwardly of the vertical member 24 into the space between the vertical member 24 and plate member 16 to limit the amount of pivoting of the bracket means 23 about the vertical axis of the member 24.

Additional means are provided to vary the angle of throw or discharge of the washer W in relation to the horizontal plane of the playing surface 6*a*. The additional means to vary the angle of throw of the washer in relation to the horizontal plane of the surface 6*a* includes an additional channel shaped member referred to generally by the numeral 40 which is supported by the upper channel shaped member 27. The additional channel shaped member 40 is provided with sides 41, 42. They are joined at their outer ends by the threaded socket 41*a* in which handles 41*b* and 41*c* may be connected. If desired, the outer end portion of the sides 41, 42 may be at an angle relative to the portion of the sides 41, 42 that are adjacent the sides 28, 29 of the upper channel member 27, as shown in the drawings.

Slots 41' are provided in each of the sides 28 and 29 of the upper channel shaped member 27. A pin 40' extends through an opening 41*a*, 42*a* in each of the sides 41 and 42, respectively, of the additional channel member 40, as well as through the slot 41' in each of the sides 28 and 29 of the upper channel shaped member 27. This arrangement accommodates positioning of the additional channel shaped member 40 longitudinally relative to the upper channel shaped member 27 in a desired manner, as will be described.

More particularly, it will be noted that the additional channel shaped member 40 has secured to the upper edges of the sides 41 and 42 thereof a pin 44 which not only connects and maintains the sides 41 and 42 in spaced relation but which projects beyond the sides 28, 29 of the upper channel shaped member 27 as shown in FIGS. 2 and 3 of the drawings. If desired a seat of elastomer as referred to by the letter E may be provided on the forward edge of the member 32 to impinge against the pin 44 when the member 32 is pulled back and then released to throw the washer W.

Also, at least a pair of spaced notches 50, 51 of preferably semicircular shape are provided in the upper edges of the sides 28 and 29 of the upper channel shaped member 27 as shown in FIGS. 2 and 3 of the drawings. The tension in the spring S is such that when the pin 44 is in the notches 50 in 28 and 29, there is some force tending to urge the member 32 against pin 44, but not as much as when the pin 44 is moved from the notched 50 and then seated in the notches 51 in the upper edges of the sides 28, 29.

To accomplish such movement, the additional channel shaped member 40 may be manually grasped and pivoted upwardly about pin 40' so that the sides 41, 42 are lifted upwardly relative to the sides 28, 29 of the upper channel shaped member 27 which lifts the pin 44 out of the notches 50. The additional channel shaped member 40 may be moved or pulled rearwardly relative to the upper channel shaped member 27 so as to align and seat the pin 44 with the notches 51 in each side 28 and 29. This places additional tension in the spring S acting on the member 32 and also positions the member 32 at a different angle relative to the horizontal plane of the surface 6*a*.

Thereafter, a washer W may be placed on the seating surface 34 and abutted against the back surface 35 and the enlargement 36 manually engaged so as to pull the member 32 rearwardly between sides 41, 42 and against the force of the spring S. When the member 32 is released, it will move between the sides 41, 42 toward the playing surface 6 until it strikes the pin 44 which suddenly stops movement of the rod 32. This causes the washer W to be thrown onto the playing surface 6*a* at an angle generally defined as shown in FIG. 2, which is the angle of the plane of seat 34 in relation to the plane of the surface 6*a* of the playing surface means 6 as shown in FIG. 2 of the drawings.

It is to be also noted that the angle of the seat 34 in relation to the surface 6*a* is different when the pin 44 is in the recesses 50.

Since the bracket means 23 including washer shooting means 10 can be pivoted laterally relative to the longitudinal axis of the playing surface 6*a*, the angle of throwing the washer W in relation to the longitudinal axis of the playing surface 6*a* may be varied. Further the angle of throwing the washer W on the surface 6*a* in relation to the horizontal plane of the surface 6*a* may be varied, by the position of pin 44 in notches 50 or 51. Also, the combination of the above angles of throwing the washer W onto the playing surface 6*a* may be determined by the player before each washer is thrown.

In using the game of the present invention, various points may be assigned to each of the holes 9*a* as desired. For example, if the washer is thrown into either of the larger holes 9*a* more remote from the end 8*a*, this may count for five points or three points or any points that the players may wish. On the other hand, a different number of points may be assigned to each of the openings 9*a* on either side of the larger opening 9*a* and closer to the ends 8 of the playing surface.

In addition, the player may aim the washer W at one or more of the guide surface 12 in an effort to bank it into one of the openings 9*a*.

If the game of the present invention is to be employed where twenty-one or bust is played, the line referred to by the letter L is employed. The line L is adjacent but rear of the two openings 9*a* and may be positioned approximately ten inches from each end 8. During the play of twenty-one or bust, where a player must get exactly twenty-one points or if he exceeds this number, then he is reduced to zero and must start over, any washers between the line L and the end 8 at each end of the playing surface means 6 may not be counted. Also, if a washer does not go beyond the line L′ when it is thrown onto the playing surface 6′, it may be replayed, that is, rethrown.

It can be appreciated that a shooter can be positioned on each end of the playing surface means 6 and the playing surface means 6 may be provided with legs if desired as shown at 5 to position it in a desired vertical position above a floor or other support surface. One, two, three or four people may play the game with each taking turns and scoring as desired and by way of example in the manner as described herein.

The foregoing disclosure and description of the invention are illustrative and explanatory thereof, and various changes in the size, shape, and materials as well as in the details of the illustrated construction may be made without departing from the spirit of the invention.

What is claimed is:

1. A washer game comprising:

a. a game board surface providing playing surface means having pocket means therein for receiving washers;

b. sides and ends projecting upwardly above the plane of said playing surface means to assist in retaining washers on the playing surface; and c. washer shooter means adjacent each of said playing surface ends to throw a washer onto the playing surface to try to put the washers in the pocket means, said washer shooter means including:

1. support means to hang on said end of said playing surface means;

2. bracket means pivotally supported on said support means, whereby the washer shooter means is pivotally mounted in a vertical axis relative to the game board playing surface to enable the washer shooter means to be positioned at various angles relative to the longitudinal axis of the gameboard playing surface, said bracket means including:

an upwardly extending member pivotally connected to said support means; an upper member connected adjacent the upper end of said vertical member, and extending rearwardly therefrom; and a lower member connected adjacent the lower end of said upwardly extending member and extending rearwardly relative thereto;

3. washer support means including: a movable member pivotally connected to said lower member and extending upwardly to terminate above said upper member; and a seating surface for receiving and supporting a washer thereon; and 4. spring means connected at one end to said upwardly extending member of said bracket means and at its other end to said movable member whereby said washer support means may be engaged and pulled away from said end of said playing surface and released whereupon said spring moves said movable member toward said game board to throw the washer supported thereon onto said game board playing surface.

2. The game of claim 1 wherein said playing surface is provided with upwardly extending spaced surface means against which the washers may be propelled to deflect the washers into the pocket means.

3. The game of claim 1 wherein said pocket means includes three openings on said playing surface means, adjacent, but spaced from each end of said playing surface means and wherein said openings are arranged with one opening being positioned more remote from each of said ends of said playing surface means than the other two openings.

4. A washer shooter means to propel a washer onto a game board playing surface including:

a. support means to hang on said end of said playing surface means;

b. bracket means pivotally supported on said support means, whereby the washer shooter means is pivotally mounted in a vertical axis relative to the game board playing surface to enable the washer shooter means to be positioned at various angles relative to the longitudinal axis of the game board playing surface, said bracket means including:

1. an upwardly extending member pivotally connected to said support means;

2. an upper member connected adjacent the upper end of said vertical member, and extending rearwardly therefrom; and 3. a lower member connected adjacent the lower end of said upwardly extending member and extending rearwardly relative thereto;

c. washer support means including:

1. a movable member pivotally connected to said lower member and extending upwardly to terminate above said upper member; and 2. a seating surface for receiving and supporting a washer thereon; and d. spring means connected at one end to said upwardly extending member of said bracket means and at its other end to said movable member whereby said washer support means may be engaged and pulled away from said end of said playing surface and released whereupon said spring moves said movable member toward said game board to throw the washer supported thereon onto said game board playing surface.

5. The invention of claim 4 including means to vary the angle of said washer support means in relation to the horizontal plane of said game board playing surface to selectively control the angle of throw of the washer onto the game board surface means.

6. The invention of claim 5 wherein said means to vary the angle of said washer support means includes:

a. additional means supported by said upper member and extending longitudinally thereof;

b. slot means in said upper member;

c. pin means extending through said slot means, upper and additional means to accommodate limited relative longitudinal movement between said upper member and additional means;

d. longitudinally spaced notches in said upper member and e. pin means secured to and extending laterally of said additional means to be selectively engaged in said longitudinally spaced notches and thereby act as a stop means for said washer support means to stop said movable member in a predetermined position as said spring means moves said movable member toward said game board surface to predetermine the angle of throw of the washer onto the game board surface means in relation to the horizontal plane of the game board surface means.

7. The washer shooter means of claim 6 including elastomer means on said washer support means for engaging said pin means when said washer support means impinges against said pin means.

8. The washer shooter means of claim 6 wherein said seating surface includes seat means to seat a washer thereon and an arcuate support extending upwardly from the rear portion of said seating surface to aid in retaining a washer on said seat means when said washer support means is actuated to move and propel the washer onto the game board playing surface.

* * * * *